US009004814B2

(12) United States Patent
Petrillo

(10) Patent No.: US 9,004,814 B2
(45) Date of Patent: Apr. 14, 2015

(54) PASSIVE UNDERGROUND FLOOD PROTECTION

(71) Applicant: Stephen Petrillo, New Hyde Park, NY (US)

(72) Inventor: Stephen Petrillo, New Hyde Park, NY (US)

(73) Assignee: New York City Transit Authority, New York, NY (US)

( * ) Notice: Subject to any disclaimer, the term of this patent is extended or adjusted under 35 U.S.C. 154(b) by 46 days.

(21) Appl. No.: 13/775,715

(22) Filed: Feb. 25, 2013

(65) Prior Publication Data

US 2014/0241804 A1 Aug. 28, 2014

(51) Int. Cl.
*E02B 5/08* (2006.01)

(52) U.S. Cl.
CPC ..... *E02B 5/082* (2013.01)

(58) Field of Classification Search
CPC ..... E03F 5/0404; E03F 7/02; E02D 29/1436; E02B 5/082
USPC ..... 405/36, 37, 39, 40, 80, 87, 88, 89, 92, 405/93, 94, 99, 100, 104, 106; 137/403, 137/408; 210/163, 164, 165; 404/2, 3, 4, 5
See application file for complete search history.

(56) References Cited

U.S. PATENT DOCUMENTS 5,460,462 A 10/1995 Regan
6,217,756 B1 * 4/2001 Martinez ..... 210/163
6,623,209 B1 9/2003 Waters, Jr.
6,726,402 B1 * 4/2004 Martinez ..... 405/40
7,101,114 B1 9/2006 Waters, Jr.
7,497,644 B1 3/2009 Cohen
8,033,753 B2 10/2011 Waters, Jr.
2007/0215212 A1 * 9/2007 Demeniuk ..... 137/362

FOREIGN PATENT DOCUMENTS

JP 2005061201 A 3/2005

OTHER PUBLICATIONS

Floodbreak—Flood Control for Vent Shafts, www.floodbreak.com/?id=243—date retrieved Jul. 30, 2012, 1 pg.
Self Closing Flood Barrier—Passive Flood Device—Global Flood Defense, www.globalfloods.com/selfclosingfloodbarrier.aspx—date retrieved Jul. 30, 2012, 2 pgs.

* cited by examiner

*Primary Examiner* — Sean Andrish
*Assistant Examiner* — Carib Oquendo

(57) ABSTRACT

Some examples provide methods, systems, devices and/or apparatus related to reducing and/or restricting water from entering underground transportation system, and more Specifically, to reducing and/or restricting water from entering underground transportation systems via vents based on the weight of the water, while not restricting ventilation airflow when water is not present. Some example systems for restricting water flow in a surface vent may include a frame that receives water, a door pivotally coupled to the frame(where the door may pivot between a first position and a second position), and a reservoir pivotally coupled to the door. The reservoir may collect the received water and may cause the door to pivot between the first position and the second position based on weight of the collected water.

20 Claims, 4 Drawing Sheets

PASSIVE UNDERGROUND FLOOD PROTECTION

BACKGROUND

Underground systems such as underground transportation systems conventionally employ many electrical and mechanical subsystems to maintain operation. For example, underground transportation systems (e.g., subways, trains) typically incorporate ventilation subsystems, power subsystems, control subsystems, and the like. Many of these subsystems typically fail or at least operate poorly or inefficiently when in contact with water, whether from environmental or man-made causes.

Ventilation subsystems, for example, typically operate to remove gases and particles from the air and to maintain operating temperatures of the underground transportation system. In this manner, the quality of breathable air underground and the operating temperatures are maintained at acceptable levels for the passengers and the technical requirements of the subsystems, respectively. If air quality is not maintained at an acceptable level, then passengers and operators of the underground transportation system may be negatively affected. Similarly, if the operating temperatures are not maintained at an acceptable level, then subsystems may fail, malfunction, and/or operate inefficiently. Therefore, ventilation of underground air is critical to maintain optimal conditions for underground transportation systems.

Rain, for example, may temporarily cause flooding in underground transportation systems. Similarly, water from fire hydrants on the surface may also flood underground transportation systems. Such water may cause pooling of water on, near, or over certain components of subsystems, causing failures, malfunctions, and/or inefficiencies of such subsystems.

Water typically enters underground transportation systems via ventilation grates on sidewalks and roads. MTA New York City Transit, for example, has between 30,000 to 40,000 ventilation grates. Conventionally, water entering ventilation grates has been removed via pumps. Such pumping can be inadequate in times of surface flooding due to heavy rain.

Therefore, it may be desirable to reduce and/or restrict water from entering underground transportation systems via vents. It may also be desirable to control the flow of water from the surface to underground transportation systems to maintain operating conditions and to reduce the need for water pumps.

BRIEF DESCRIPTION OF THE DRAWINGS

The foregoing and other features of the present disclosure will become more fully apparent from the following description and appended claims, taken in conjunction with the accompanying drawings. Understanding that these drawings depict several embodiments in accordance with the disclosure and are, therefore, not to be considered limiting of its scope, the disclosure will be described with additional specificity and detail through use of the accompanying drawings.

In the drawings.

DETAILED DESCRIPTION

Figure 1:
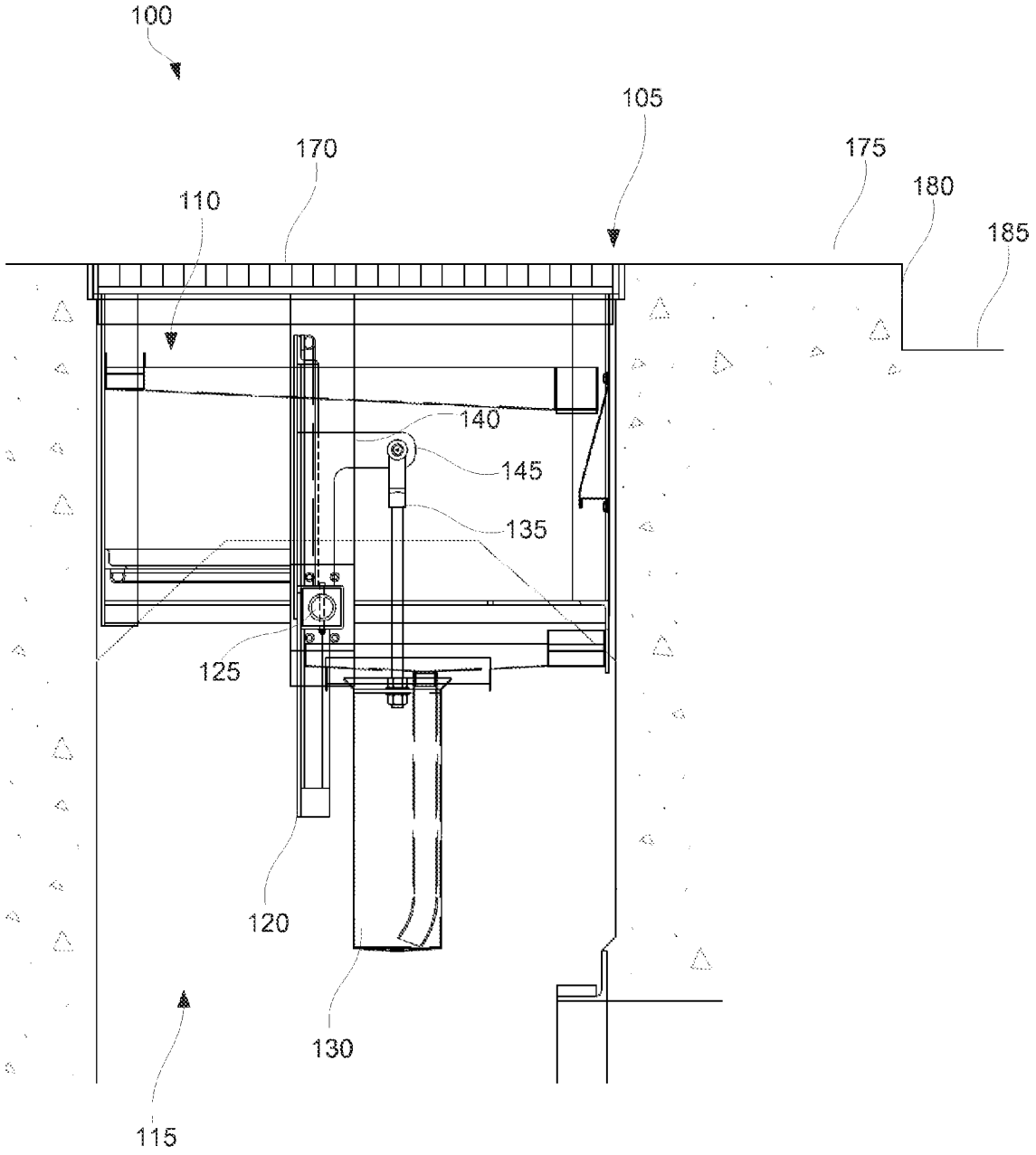
FIG. 1 depicts an example flood protection system that may be used to reduce and/or restrict water from entering underground transportation systems.

In the following detailed description, reference is made to the accompanying drawings, which form a part hereof. In the drawings, similar symbols identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, each of which are explicitly contemplated and made part of this disclosure.

This disclosure is generally drawn to methods, systems, devices and/or apparatus related to reducing and/or restricting water from entering underground systems. Specifically, the disclosed methods, systems, devices and/or apparatus relate to reducing and/or restricting water from entering underground systems via vents based on the weight of the water, while not restricting ventilation airflow. In some examples, a mechanical closure device may be disposed in a vent shaft. The mechanical closure device may open and close based on the amount (and, therefore, the weight) of water passing through the vent shaft. While this disclosure may be applicable to any underground system, for brevity, this disclosure only discusses some example underground transportation systems in detail.

FIG. 1 depicts an example flood protection system 100 that may be used to reduce and/or restrict water from entering underground transportation systems, in accordance with at least some embodiments of the present disclosure. Flood protection system 100 may receive water through a grating 170 from the surface (e.g., a sidewalk 175, a curb 180, a road 185) 105. Example flood protection system 100 may include a frame 110 within a vent shaft 115. Example flood protection system 100 may also include a door 120 coupled to frame 110 via a pivoting mechanism 125. Door 120 may be coupled to a reservoir(s) 130.

Example flood protection system 100 depicts door 120 coupled to reservoir 130 via a linkage member 135, which may be pivotably coupled to a door flange 140 via a pivoting mechanism 145. In some examples, reservoir 130 may be directly coupled to door 120 via a pivoting mechanism.

Figure 4:
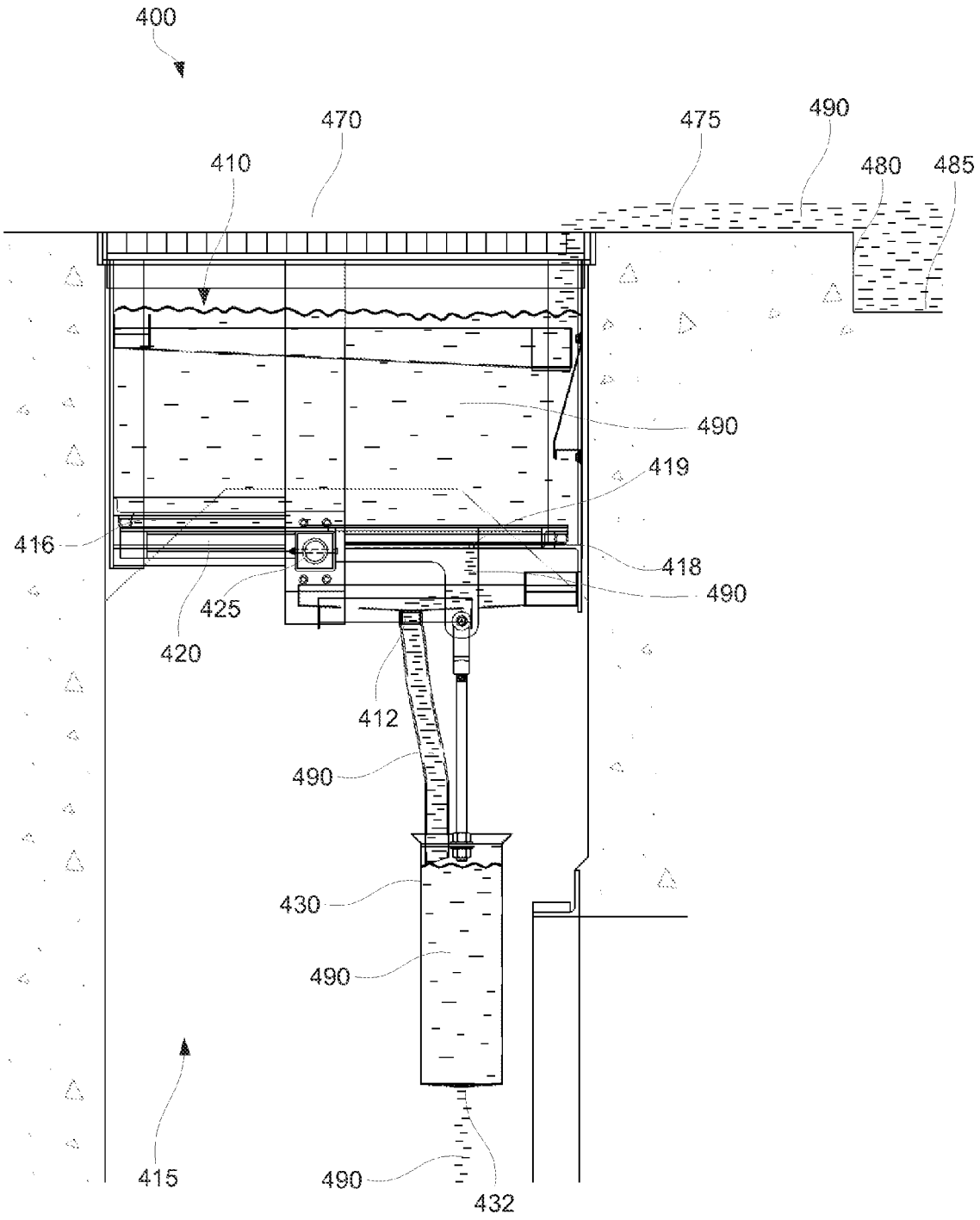
FIG. 4 depicts another example flood protection system that may be used to reduce and/or restrict water from entering underground transportation systems, each arranged in accordance with at least some embodiments of the present disclosure.

Reservoir 130 may collect water that enters through frame 110. In some examples, water may be channeled from frame 110 into reservoir 130. As water is collected in reservoir 130, the weight of such water may cause a downward force to be applied on door 120. This force may cause the door to pivot between a first position (e.g., as depicted in FIG. 1) and the second position (e.g., as depicted in FIG. 4) based on a weight of the collected water in reservoir 130. In some examples, the first position may be a vertical orientation, while the second position may be a horizontal orientation. In some examples, the first position may be an open orientation, while the second position may be a closed orientation.

In some examples (such as depicted in FIG. 1), door 120 may pivot about pivoting mechanism 125 to transition from the first position to the second position. Example flood protection system 100 depicts door 120 in a first position in which water may freely enter example flood protection system 100 and air from the underground transportation system below may freely enter or exit without redirection of airflow. In some examples, when door 120 is in the second position, water may be restricted exiting the frame into vent shaft 115.

In some examples, door 120 may be curved and/or may have a crown such that water is directed away toward an outer portion of door 120.

Figure 2:
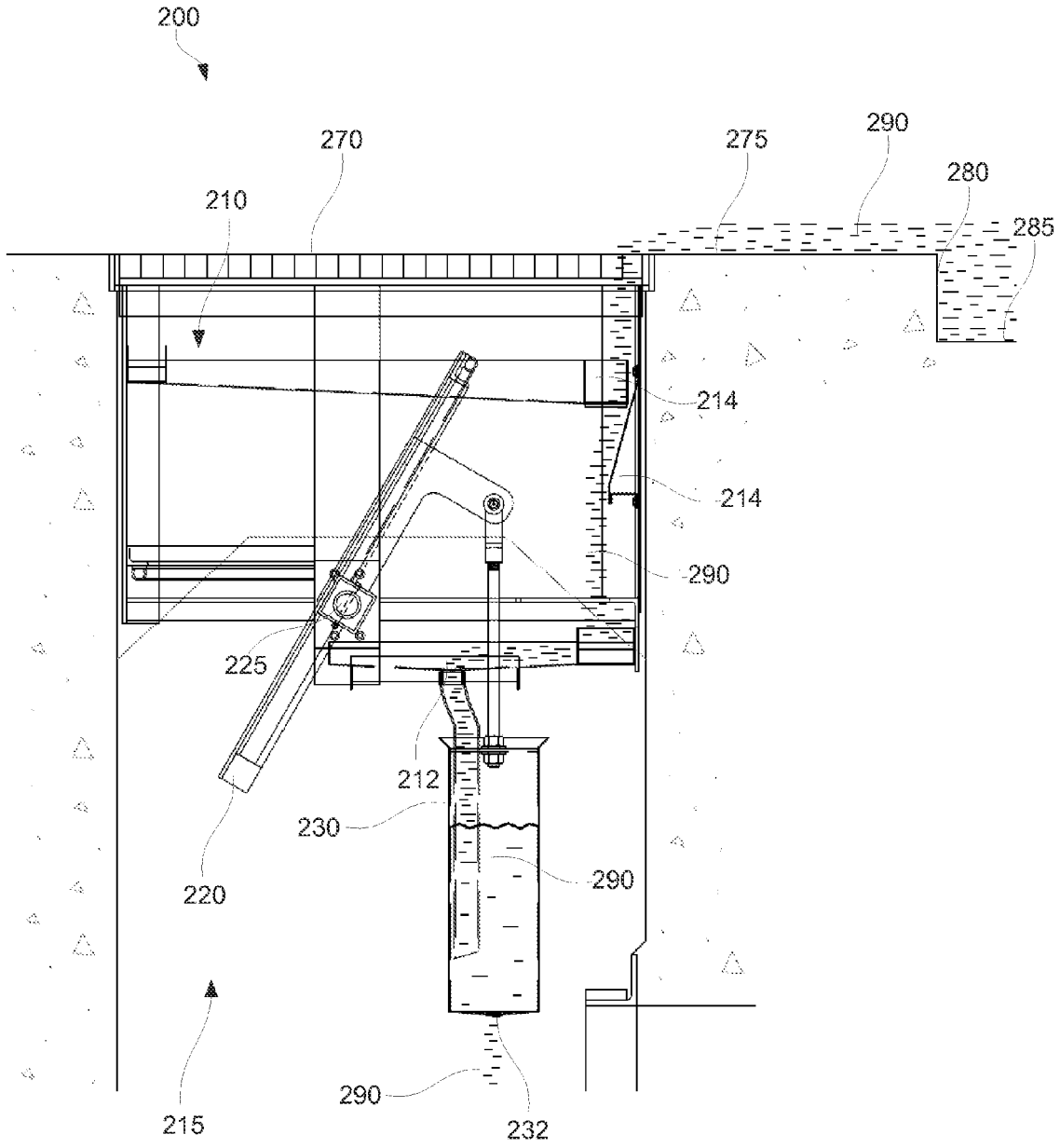
FIG. 2 depicts another example flood protection system that may be used to reduce and/or restrict water from entering underground transportation systems.

FIG. 2 depicts an example flood protection system 200 that may be used to reduce and/or restrict water from entering underground transportation systems, in accordance with at least some embodiments of the present disclosure. Example flood protection system 200 depicts a transition between a first position and a second position. FIG. 2 also depicts water 290 (e.g., rain floodwater, man-made floodwater) covering road 285 and rising above curb 280 onto sidewalk 275. Water 290 may flow from road 285 onto sidewalk 275 and through grating 270 into frame 210.

As water 290 enters frame 210 through grating 270, water 290 may be directed by gutter(s) and/or channel(s) 214 as it flows toward the bottom of frame 210. Water 290 may be channeled through frame weep hole 212 into reservoir 230 at a certain flow rate (i.e., first flow rate).

In some examples, reservoir 230 may include a reservoir debris shield (e.g., screen) to restrict and/or block debris from entering reservoir 230. Example debris may include man-made materials (e.g., cigarette butts), organic materials (e.g., tree leaves), and the like.

Reservoir 230 may include a reservoir weep hole 232. As water 290 collects in reservoir 230, a portion of water 290 exits reservoir 230 via reservoir weep hole 232. Water 290 exiting reservoir weep hole 232 may exit reservoir 230 at a certain rate (i.e., second flow rate). If the first flow rate (i.e., flow rate of water exiting frame weep hole 212) exceeds the second flow rate (i.e., flow rate of water exiting reservoir weep hole 232), reservoir 230 will fill with water 290. In some examples, water 290 exiting reservoir weep hole 232 may fall into the vent shaft 215.

As reservoir 230 fills with water 290, the weight of water 290 causes a force that pulls door 220 downward. As door 220 is pulled downward, door 220 may pivot about a pivoting mechanism 225. In this manner, the weight of water 290 in reservoir 230 causes door 220 to transition from an open position to a closed position. In some examples, the center of gravity of door 220 may shift, causing door 220 to transition from an open position to a closed position.

In some examples, the flow rate of water 290 exiting frame weep hole 212 is greater than the flow rate of water 290 exiting reservoir weep hole 232. When the flow rate of water 290 exiting frame weep hole 212 is greater than the flow rate of water 290 exiting reservoir weep hole 232, reservoir 230 empties slower than frame 210 empties. This allows reservoir 230 to remain full as long as water 290 continues to exit frame 210. In this manner, if water 290 is flowing at a high rate into frame 210, door 220 may remain closed because reservoir 230 remains heavy enough to keep door 220 in the closed position (i.e., reservoir 230 collects and temporarily retains enough water 290 to weigh down door 220). As a flood event subsides, the weight of reservoir 230 subsides, and reservoir 230 causes door 220 to transition from a closed position to an open position.

Figure 3:
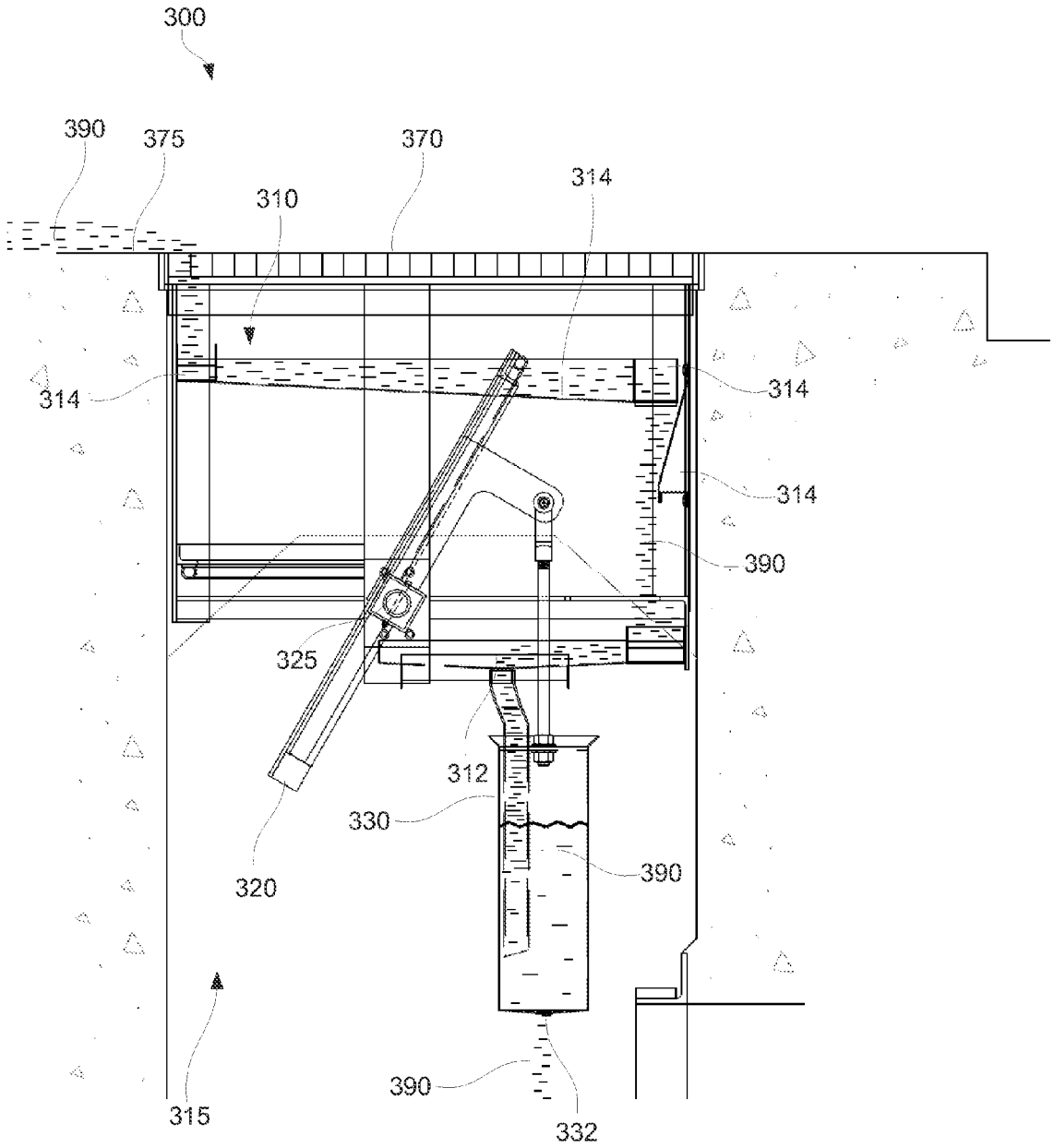
FIG. 3 depicts yet another example flood protection system that may be used to reduce and/or restrict water from entering underground transportation systems.

FIG. 3 depicts another example flood protection system 300 that may be used to reduce and/or restrict water from entering underground transportation systems, in accordance with at least some embodiments of the present disclosure. Similar to FIG. 2, example flood protection system 300 depicts a transition between a first position and a second position. FIG. 3 also depicts water 390 (e.g., rainwater, man-made floodwater) flowing onto sidewalk 375 (e.g., water flowing from and/or off a building) and through grating 370 into frame 310.

As water 390 enters frame 310 through grating 370, water 390 may be directed by gutter(s) and/or channel(s) 314 as it flows toward the bottom of frame 310. Water 390 may be channeled through frame weep hole 312 into reservoir 330 at a certain flow rate (i.e., first flow rate).

Reservoir 330 may include a reservoir weep hole 332. As water 390 collects in reservoir 330, a portion of water 390 exits reservoir 330 via reservoir weep hole 332. Water 390 exiting reservoir weep hole 332 may exit reservoir 330 at a certain rate (i.e., second flow rate). If the first flow rate (i.e., flow rate of water exiting frame weep hole 312) exceeds the second flow rate (i.e., flow rate of water exiting reservoir weep hole 332), reservoir 330 will fill with water 390. In some examples, water 390 exiting reservoir weep hole 332 may fall into the vent shaft 315.

As reservoir 330 fills with water 390, the weight of water 390 causes a force that pulls door 320 downward. As door 320 is pulled downward, door 320 may pivot about a pivoting mechanism 325. In this manner, the weight of water 390 in reservoir 330 causes door 320 to transition from an open position to a closed position. In some examples, the center of gravity of door 320 may shift, causing door 320 to transition from an open position to a closed position.

In some examples, the flow rate of water 390 exiting frame weep hole 312 is greater than the flow rate of water 390 exiting reservoir weep hole 332. When the flow rate of water 390 exiting frame weep hole 312 is greater than the flow rate of water 390 exiting reservoir weep hole 332, reservoir 330 empties slower than frame 310 empties. This allows reservoir 330 to remain full or near full as long as water 390 continues to exit frame 310. In this manner, if water 390 is flowing at a high rate into frame 310, door 320 may remain closed because reservoir 330 remains heavy enough to keep door 320 in the closed position (i.e., reservoir 330 collects and temporarily retains enough water 390 to weigh down door 320). As a flood event subsides, the weight of reservoir 330 subsides, and reservoir 330 causes door 320 to transition from a closed position to an open position.

FIG. 4 depicts another example flood protection system 400 that may be used to reduce and/or restrict water from entering underground transportation systems, in accordance with at least some embodiments of the present disclosure. Example flood protection system 400 depicts a door 420 in a closed position. Like FIG. 2, FIG. 4 depicts water 490 (e.g., rainwater, man-made floodwater) covering road 485 and rising above curb 480 onto sidewalk 475. Water 490 may flow from road 485 onto sidewalk 475 and through grating 470 into frame 410.

In FIG. 4, door 420 is closed and frame 410 is partially filled with water 490. Door 420 and frame 410 effectively form a seal such that water 490 may not exit frame 410 other than through frame weep hole 412. In some examples, a compression seal(s) may be coupled to door 420 and frame 410 such that a watertight seal is formed between door 420 and frame 410 when door 420 is in the closed position. In some examples, this seal may be formed by a portion of door 420 contacting a portion 416 of a frame 410 and another portion of door 420 contacting another portion 418 of frame 410. When door 420 is in the closed position, water 490 may pass through portion 418 of frame 410 via weep hole 419. Weep hole 419 in portion 418 of frame 410 may have approximately the same flow rate as frame weep hole 412. Frame weep hole 412 may allow a portion of water 490 to exit frame 410 and flow into reservoir 430. Water 490 exiting frame weep hole 412 may exit frame 410 at a certain rate (i.e., flow rate). In some examples, water 490 exiting frame weep hole 412 may be directed into reservoir 430.

Reservoir 430 may include a reservoir weep hole 432. As water 490 collects in reservoir 430, a portion of water 490 may exit reservoir 430 via reservoir weep hole 432. In some examples, water 490 exiting reservoir weep hole 432 may fall into the vent shaft 415.

In some examples, the flow rate of water 490 exiting frame weep hole 412 is greater than the flow rate of water 490 exiting reservoir weep hole 432. When the flow rate of water 490 exiting frame weep hole 412 is greater than the flow rate of water 490 exiting reservoir weep hole 432, reservoir 430 empties slower than frame 410 empties. This allows reservoir 430 to remain full (or near full) as long as water 490 continues to exit frame 410. In this manner, if water 490 is flowing at a high rate into frame 410, door 420 may remain closed because reservoir 430 remains heavy enough to keep door 420 in the closed position (i.e., reservoir 430 collects and temporarily retains enough water 490 to weigh down door 420). As a flood event subsides, the weight of reservoir 430 subsides, and reservoir 430 causes door 420 to transition from a closed position to an open position.

As water 490 exits reservoir 430, the weight of water 490 is reduced, thus causing a lesser force to pull door 420 downward. As the weight of water 490 is reduced, door 420 may pivot about a pivoting mechanism 425. In this manner, the reduced weight of water 490 in reservoir 430 causes door 420 to transition from a closed position to an open position. In some examples, the center of gravity of door 420 may shift, causing door 420 to transition from a closed position to an open position.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A system for restricting water flow in a surface vent, the system comprising:

a frame configured to receive water;

a door pivotally coupled to the frame, the door configured to pivot between a first position allowing the received water to exit the frame without restriction and a second position restricting substantially all of the received water from exiting the frame;

a reservoir pivotally coupled to the door, the reservoir configured to collect at least a portion of the received water and further configured to cause the door to pivot between the first position and the second position based on a weight of the collected water.

2. The system of claim 1, wherein the first position allows air from below the frame to exit to a surface, and allows air from above the surface to enter the frame; and wherein the second position at least partially restricts the air from below the frame from exiting to the surface, and at least partially restricts the air from above the surface from entering the frame.

3. The system of claim 1, wherein the first position comprises a vertical orientation; and wherein the second position comprises a horizontal orientation.

4. The system of claim 1, wherein the first position comprises an open orientation; and wherein the second position comprises a closed orientation.

5. The system of claim 1, wherein the frame includes a frame weep hole in which at least a portion of the received water exits at a first flow rate.

6. The system of claim 1, wherein the reservoir includes a reservoir weep hole in which at least a portion of the collected water exits at a second flow rate.

7. The system of claim 1, further comprising:

a grating disposed at a surface above the frame, the grating having one or more openings adapted to allow the water from the surface to reach the frame, allow air from below the frame to exit to the surface, and allow air from the surface to enter the frame.

8. The system of claim 1, further comprising:

one or more gutters configured to direct at least a portion of the received water into the reservoir.

9. The system of claim 1, further comprising:

a reservoir debris shield configured to restrict debris from entering the reservoir.

10. The system of claim 1, wherein the water enters the frame from at least one of a sidewalk, a pedestrian walkway, a storm drain, a curbside drain, and a road.

11. A system for restricting water flow in a surface vent, the system comprising:

a frame having a water ingress end and a water egress end, the frame configured to receive water from a surface via the water ingress end;

a door coupled to an interior portion of the frame, the door configured to transition between an open orientation and a closed orientation; and one or more reservoirs coupled to the door, each reservoir configured to collect at least a portion of the received water and further configured to cause the door to transition between the open orientation and the closed orientation based on a weight of the collected water in the one or more reservoirs;

wherein the open orientation allows the received water to exit the water egress end, allows air from below the frame to exit to a surface via the water ingress end, and allows air from above the surface to enter the water ingress end; and wherein the closed orientation prevents substantially all of the received water from exiting the water egress end, at least partially restricts the air from below the frame from exiting to the surface via the water ingress end, and at least partially restricts the air from above the surface from exiting the frame via the water egress end.

12. The system of claim 11, wherein gravity causes the water to flow from the water ingress end to the water egress end.

13. The system of claim 11, wherein the reservoir is positioned below the water egress end of the frame.

14. The system of claim 11, further comprising:

a frame weep hole in the frame, the frame weep hole configured to allow at least a portion of the received water to exit the frame at a first flow rate; and a reservoir weep hole in each of the one or more reservoirs, each reservoir weep hole configured to allow at least a portion of the collected water to exit the respective reservoir at a second flow rate;

wherein the first flow rate is greater than the second flow rate.

15. The system of claim 11, wherein the door transitions from the closed orientation to the open orientation as the weight of collected water in the one or more reservoirs is reduced.

16. The system of claim 11, further comprising:

one or more compression seals coupled to at least one of the door and the frame such that a watertight seal is formed between the door and the frame when the door is in the closed orientation.

17. The system of claim 11, wherein the water enters the frame from at least one of a sidewalk, a pedestrian walkway, a storm drain, a curbside drain, and a road.

18. A system for restricting water flow into a subway vent, the system comprising:

a grating disposed in a paved transportation surface;

a frame disposed beneath the paved transportation surface, the frame configured to receive water from the paved transportation surface through the grating; and a closure door coupled to an interior portion of the frame, the closure door configured to allow water to exit the frame while the closure door has a first center of gravity, and further configured to prevent the water from exiting the frame while the closure door has a second center of gravity;

a frame weep hole in the frame, the frame weep hole configured to allow at least a portion of the received water to exit the frame at a first flow rate; and wherein the closure door transitions between the first center of gravity and the second center of gravity based on the weight of the water.

19. The system of claim 18, further comprising:

one or more reservoirs coupled to the closure door, each reservoir configured to receive at least a portion of the water and further configured to cause the closure door to transition between the first center of gravity and the second center of gravity based on the weight of the water in the respective reservoir; and a reservoir weep hole in each of the one or more reservoirs, each reservoir weep hole configured to allow at least a portion of the collected water to exit the respective reservoir at a second flow rate.

20. The system of claim 18, wherein the closure door has a vertical orientation when at the first center of gravity; and wherein the closure door has a horizontal orientation when at the second center of gravity.

* * * * *